United States Patent [19]

James

[11] 4,026,343

[45] May 31, 1977

[54] COUNTERWEIGHTED BIFOLD CLOSURES

[76] Inventor: Don E. James, 952 E. 1400 S., Orem, Utah 84057

[22] Filed: Aug. 21, 1975

[21] Appl. No.: 606,667

[52] U.S. Cl. ..... 160/189; 160/207

[51] Int. Cl.[2] ..... E05F 11/54

[58] Field of Search ..... 160/189, 190, 207, 213; 49/200

[56] References Cited

UNITED STATES PATENTS

| | | | |
|---|---|---|---|
| 974,699 | 11/1910 | Ogden | 160/189 |
| 2,097,950 | 11/1937 | Johnson | 160/189 |
| 2,203,264 | 6/1940 | Horstman | 160/190 |
| 2,320,604 | 6/1943 | Jackson et al. | 160/190 UX |
| 2,327,316 | 8/1943 | Michelman | 160/189 |
| 3,839,827 | 10/1974 | Dickinson | 49/200 X |

*Primary Examiner*—Philip C. Kannan
*Attorney, Agent, or Firm*—Criddle, Thorpe & Western

[57] ABSTRACT

A closure consisting of a bifold door which is weight balanced in any given position and which, when fully opened, occupies the minimum of space. The door consists of two unequal rectangular bifold sections, the smaller of said sections being the upper section and is pivotally attached along one longitudinal side to the frame or beam at the top of the opening to be closed and the other longitudinal side is pivotally attached in an opposite pivotal direction to the lower, larger rectangular section. The lower section is connected by a system of cables and pulleys to a counterweight which applies an upward force to the bifold door which is equal to the weight or downward force of the bifold door when in a closed, or a partial or fully opened position. When fully opened, the upper rectangular section has pivoted to a position at right angles from its closed position and the lower rectangular section has pivoted 180° in relation to the upper section so as to be folded directly under said upper section. The door may be opened or closed electrically or manually, and when closed, locked in a stationary position.

14 Claims, 12 Drawing Figures

COUNTERWEIGHTED BIFOLD CLOSURES

BACKGROUND OF THE INVENTION

This invention relates to bifold door closures which are counterbalanced in weight and will remain open at any given position. More specifically, this invention relates to bifold door closures which occupy a minimum of space when in the fully open position and which are counterbalanced in weight so as to remain open in any given position and which may be opened without the use of tracks, springs, levers or other complicated mechanisms. Furthermore, this invention is related to a bifold closure which, when opened, will not sag or bind thereby allowing a complete bifolding of one section over another.

Door closures of various types, especially for large openings, are well known in the art, but all have their attending disadvantages. For example, closures used in airplane hangars, warehouses, garages and the like often raise overhead by means of a tracking system and are heavy and cumbersome to operate and/or require a torsion spring, counterweight or other mechanism to offset the weight of the door while being raised. Moreover, these doors occupy considerable space, often swing with a large arc or radius, and are not, in general, capable of being opened and balanced at any given position. These doors also usually open inwardly. Some doors are sectionalized so that, by a system of rollers on a track, they can be angled around a 90° curve in the tracking system. The mechanism for opening and closing these doors is such that the door is not balanced in any given position, and hence, will usually close by its own weight when brought to a certain partially closed position.

Another typical type of closure for large doors is a solid structure wherein the bottom swings outwardly and upwardly and the top swings backwardly in an arcuate pattern. These doors are heavy and when left open there is nothing to offset their weight and so have a tendency to easily sag and warp.

Other types of closures are known such as horizontally opening doors of either an accordian type or doors which either swing inwardly or outwardly or are bifold in equal sections. Such horizontally opening doors usually require considerable space thereby lessening the width of the opening that can be utilized for ingress or egress.

OBJECTS AND BRIEF DESCRIPTION OF THE INVENTION

It is an object of the present invention to provide a weighted and balanced bifold closure which is capable of being fully opened with a minimum of energy and which occupies a minimum of space in the open position.

It is also an object of this invention to provide a bifold closure which is balanced in any partial or fully opened position and which can be opened or closed either manually or electrically with a minimum of effort.

It is a further object of this invention to provide a bifold closure which may be closed and locked in stationary position by the inertia developed during closing and which is self sealing against weather or other outside elements.

It is an additional object of this invention to provide a bifold door which may be fully opened with minimal energy without the use of tracks, springs, levers or other complicated mechanisms.

A still further object of this invention is to provide a bifold door closure which may extend horizontally across the entire length or width of a building thereby allowing substantially one side of the building to be completely opened.

These and other objects of the invention may be accomplished by means of a novel vertically opening bifold door closure consisting of two unequal rectangular sections. The door closure may be custom made to fit any desired opening and may extend across the entire width or length of a building, if desired. The closure consists of two unequal rectangular sections, the smaller upper section of which is pivotally attached along one side to the framework or beam at the top of the opening to be closed and the larger section is pivotally attached to the opposite side of the upper section in an opposite pivotal direction so that when the closure is raised the top section will, for example, swing 90° and the lower section will swing upwardly and fold under the upper section being pivoted through a 180° angle relative to the upper section. The upper section is connected to the framework or beam at the top of the closure opening by means of hinges or other suitable means and comprises about one-fourth of the closure. In the same manner, the upper and lower sections are pivotally connected to each other by means of hinges or other suitable means and the lower section comprises about three-fourths of the closure.

The upper and lower sections both contain sealing means to provide against intrusion of weather or other elements when the bifold closure is in a closed position. The closure also contains a closing mechanism which will maintain the closure in a closed rigid locked position.

The closure may be opened by means of a series of cables connected to the lower section, about one-third of the way from the top of said section, which cables pass through a pulley or series of pulleys to a winch having the same or different predetermined diameter; also connected to and wound about a different portion of the winch is a counterweight, the weight of which may be varied to compensate for the weight of the closure to be opened. The number of connecting cables to the lower section and the number of pulleys utilized will be dependent upon the width of the door to be opened. For doors that are extremely wide it will be obvious that the closures maybe broken up into sections and each section opened independently of the other sections.

If desired, the winch may be driven in either direction by an electric motor having the appropriate horsepower.

It is often desirable to utilize a closure that will occupy as little space as possible when in the open position to allow for the maximum freedom of movement around the open space created by opening the closure. Such examples are in warehouses, docking areas, airplane hangars, food storage buildings and the like. When driving or maneuvering a truck or airplane into such a building it is necessary that the door not only open to its maximum ability, but also not interfere with the intended operations inside the building. For example, in an airplane hangar it may be desirable or necessary for the use of the airplane to nearly touch the closure.

It is often necessary, as has been previously stated, that the open space be substantially the width of the building which leaves little or no room for tracking mechanisms, levers, springs, and the like at the side of the door.

The novel features of this invention both as to the manner of construction or organization as well as the operation will be better understood with reference to the following description and drawings. It is to be understood, however, that the descriptions and drawings are for the purpose of illustration only, and are not intended to be a definition as to the scope of this invention.

DRAWINGS OF THE INVENTION

Figure 5:
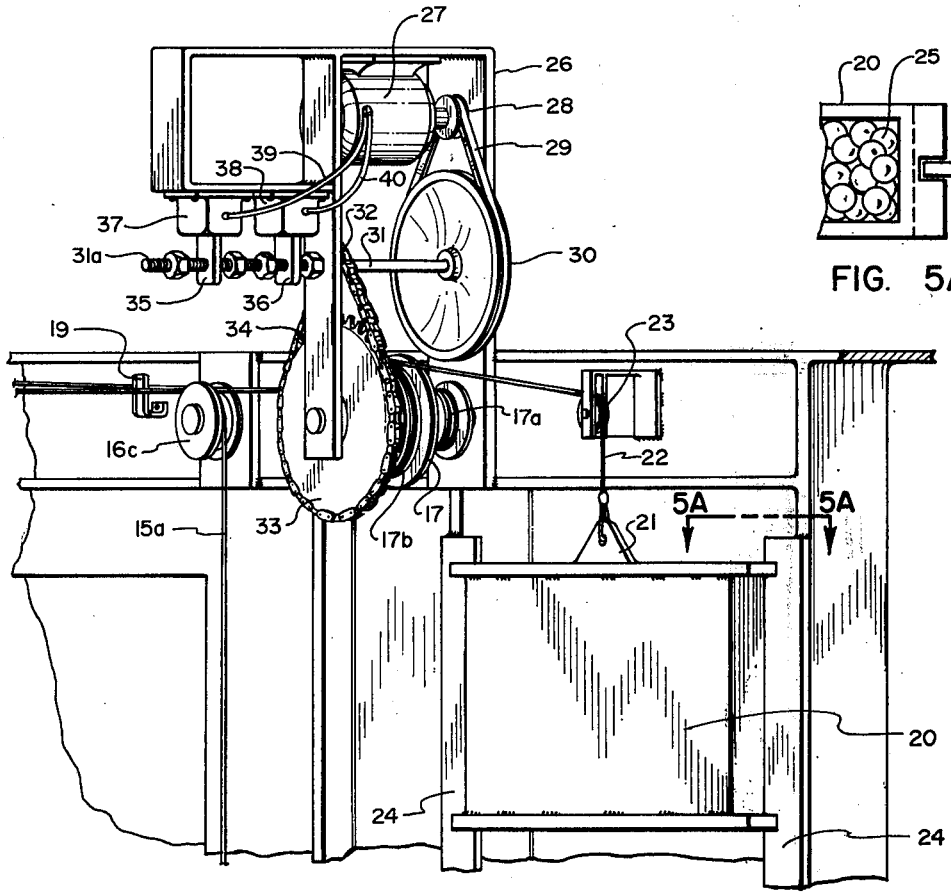
FIG. 5 is a corner sectional perspective view of one proposed arrangement of electrically opening and closing the bifold door.
Figure 5A:
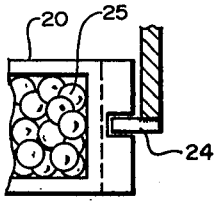

FIG. 5*a* is a partial top sectional view taken along lines 5*a*—5*a* of FIG. 5 showing the counterweight containing adjustable weights and its accompanying tracking mechanism.

Figure 2:
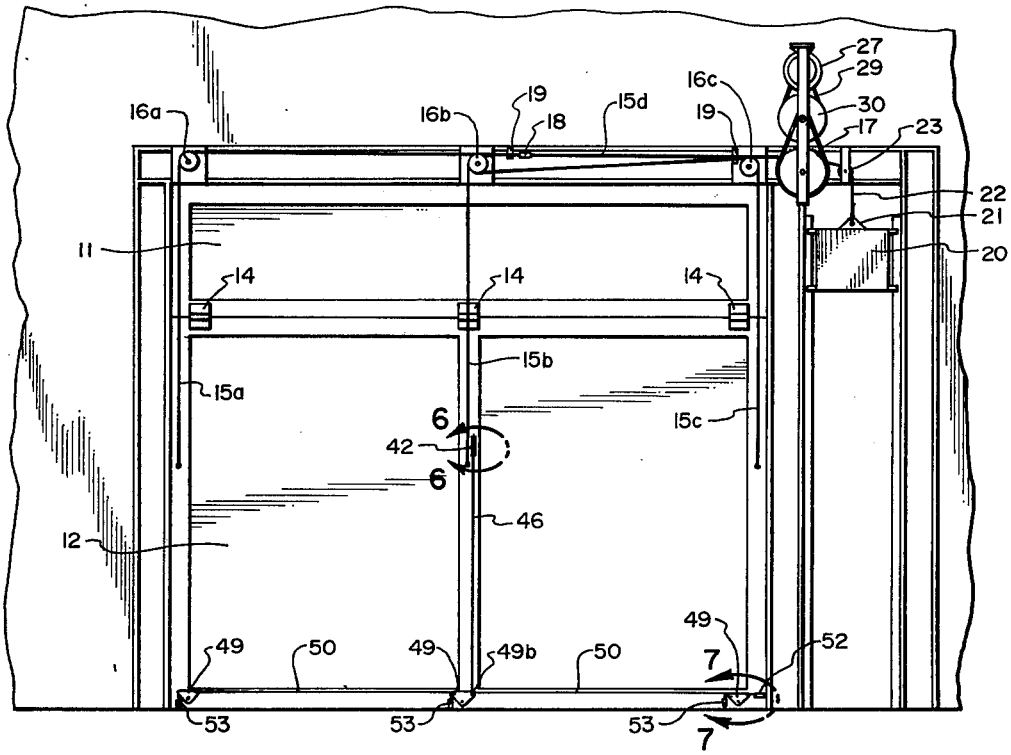
FIG. 2 is a back elevational view of FIG. 1 showing the cables and pulley system winch and the counterweight utilized in opening the door.
Figure 6:
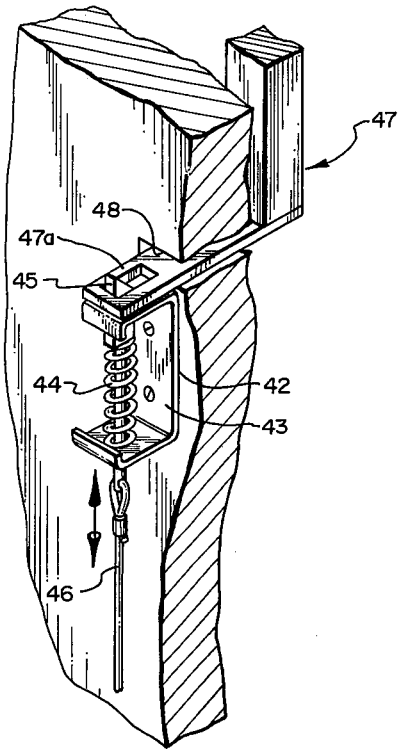

FIG. 6 is a partial break-away view of the locking mechanism holding the bifold portion of the door taken at line 6—6 of FIG. 2.

Figure 7:
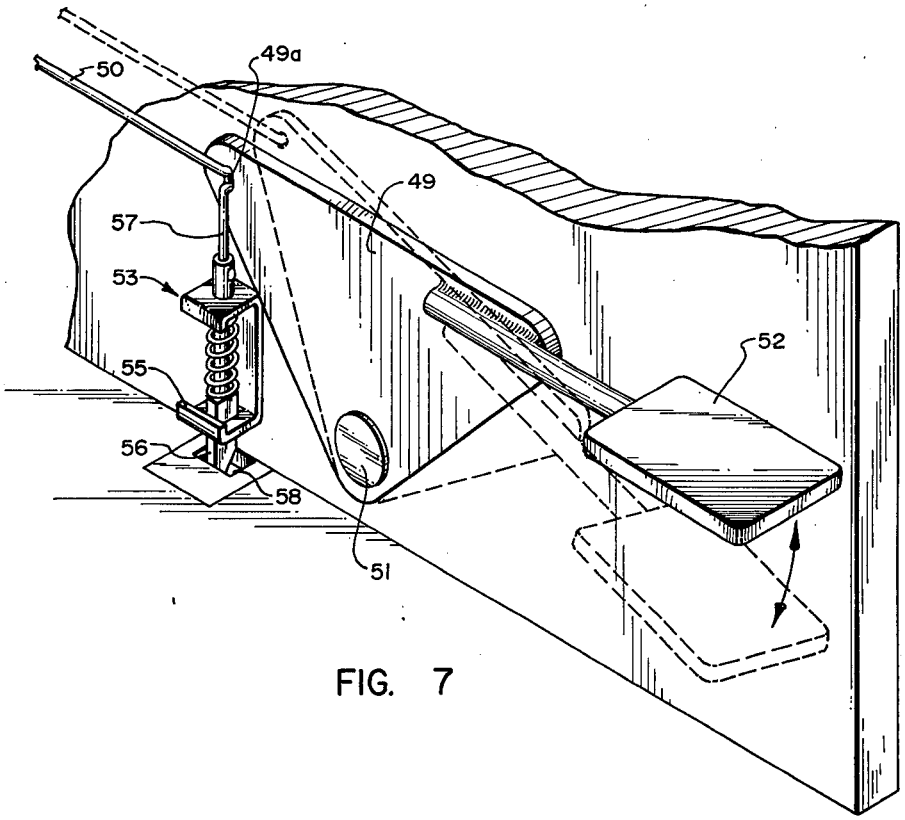

FIG. 7 is a perspective break-away view of the portion of the door shown at lines 7—7 of FIG. 2 showing the locking device at the bottom of the bifold door and the means for actuating and releasing said lock.

Figure 8:
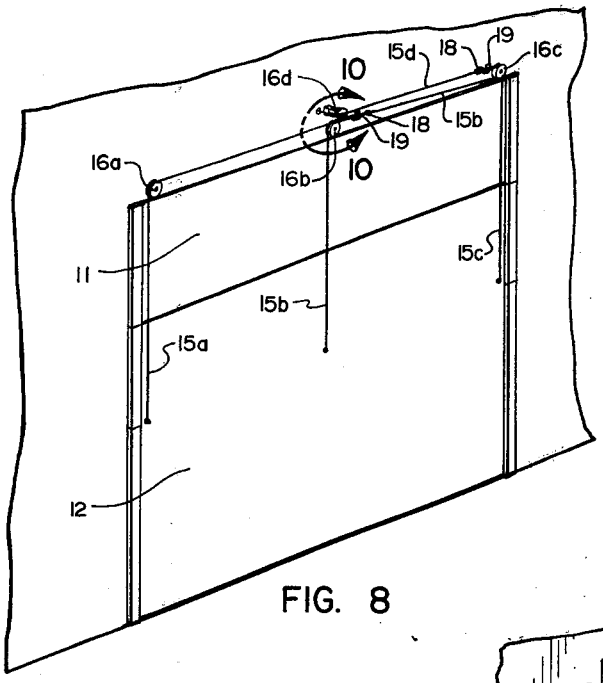

FIG. 8 is a perspective front elevational view of a bifold door in a locked position, the upper section of which, when opened, will move in an inward direction and the lower section will fold outwardly thereunder.

Figure 9:
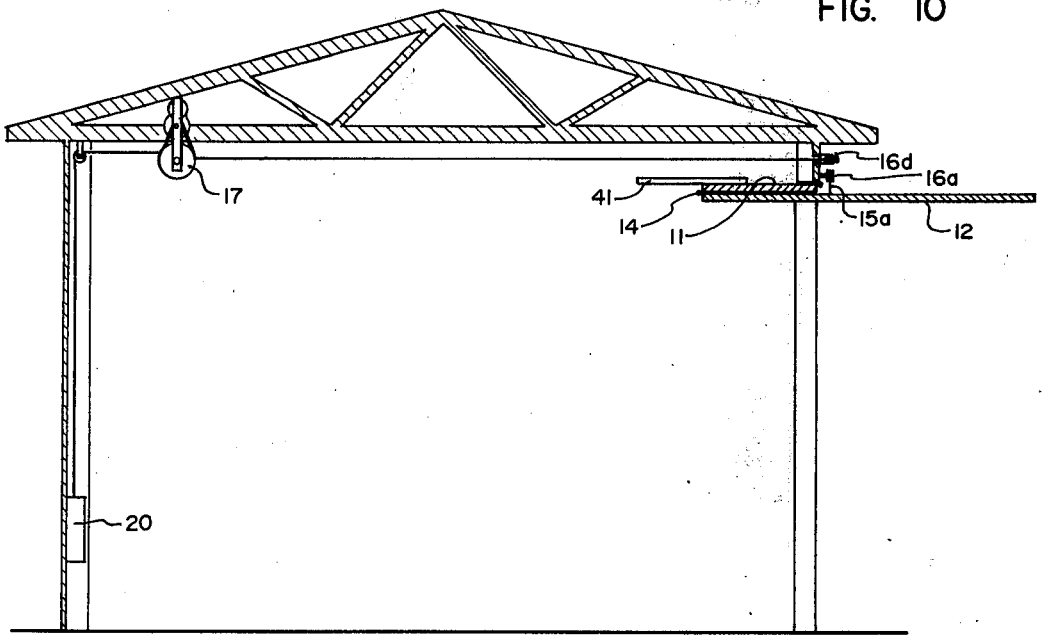

FIG. 9 is a cut-away side elevational view of an outwardly opening bifold door such as shown in FIG. 8 showing the door in a fully open position and further showing one possible remote positioning of the winch and counterweight.

Figure 10:
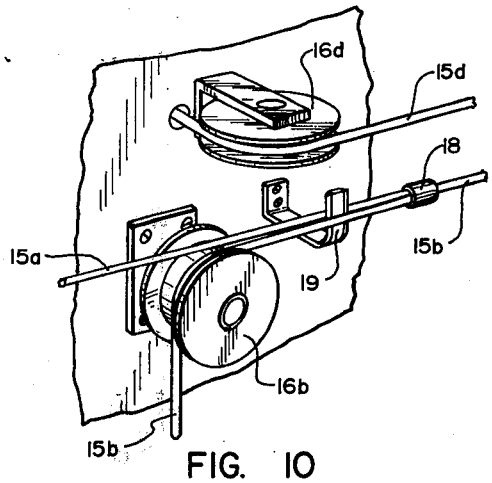

FIG. 10 is a partial sectional view taken along lines 10—10 in FIG. 8 showing one particular aspect of the cable and pulley system for opening the bifold closure as illustrated in FIG. 8.

Figure 4:
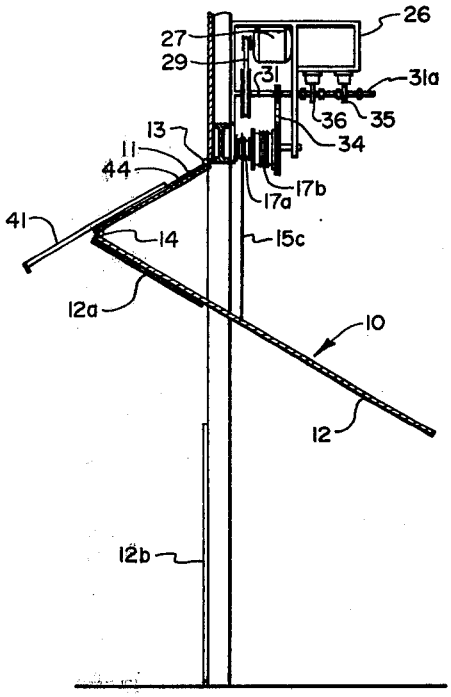
FIG. 4 is a side cross-sectional view of FIG. 3 showing the door in a partially open position taken along 4—4.
Figure 11:
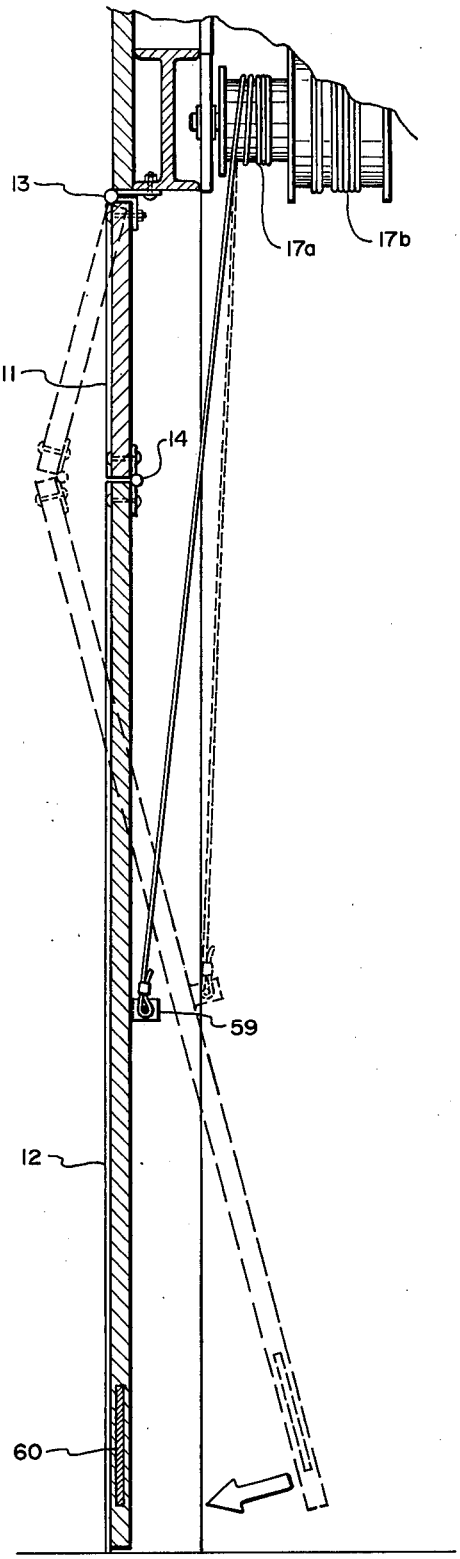

FIG. 11 is a side cross-sectional view of FIG. 4 being enlarged, and showing the lower portion of the door being weighted and the door in a closed position with the weight of the closed door being off center to allow the door to spring partially open when latching means are removed.

DETAILED DESCRIPTION

Referring now to the drawings:

There is shown in FIGS. 1 through 5 a complete operative embodiment of the bifold door closure. The closure designated generally as 10 in FIG. 1 consists of an upper rectangular section 11 and a lower larger rectangular section 12. The upper rectangular section is attached along the top longitudinal side to the frame or a beam by hinge means 13. As shown in FIG. 2 the lower section of the door 12 is hingedly attached to the upper section by hinge means 14. Hinge means 14 is attached so as to pivot oppositely from hinge means 13. The lower closure section 12 is connected to a series of cables illustrated in FIG. 2 as 15*a*, 15*b* and 15*c*, which are interconnected by pulley means 16*a*, 16*b* and 16*c*. The pulleys are mounted on the beam or framework above the bifold closure as illustrated in FIG. 2 and further illustrated in FIGS. 4 and 5. Cable 15*a* passes over pulleys 16*a* and 16*b* and is connected to cables 15*b* and 15*c* by clamp 18 to form one cable designated as 15*d*. Cable 15*b* passes around pulley 16*b* and cable 15*c* passes in an opposite direction over the top of pulley 16*c* and then around the underside of pulley 16*b*. Cables 15*b* and 15*c* are clamped, spliced, interwoven or otherwise connected, along with cable 15*a*, to form a single cable 15*d*, such point of attachment is illustrated in FIG. 2 as clamp 18. Cable 15*d* is then connected to the door raising portion 17*a* of winch 17. In order not to bind with each other or to become intertwined, cables 15*a*, 15*b* and 15*c* are separated by a cable dividing knife 19, which is attached to the framework adjacent to pulleys 16*b* and 16*c* and passes outwardly and then upwardly in a vertical direction to pass between cables 15*a*, 15*b*, 15*c* and 15*d* to keep them from becoming wound or interwined about each other.

Thus, cable 15*d* is wound on winch 17*a* when the winch is revolved in a clockwise direction as illustrated in FIGS. 2, 4 and 5. It will be noted, especially from FIG. 4, that cables 15*a*, 15*b* and 15*c* are connected to lower section of the door 12 in such a manner that the cables will be pulled upwardly in a substantially vertical direction and not at an angle. In general, the upper section 11 will comprise about one-fourth of the vertical height of the bifold closure and the lower section will be about three-fourths of the vertical height. The cables will be attached to the lower section 12 about one-third of the way from the top of said section. In other words, the point of attachment of the cables to section 12 is about one-half way down from the top of the vertical bifold closure. As illustrated in FIGS. 1–4, the upper section of the door connected at hinge 13 will rise upwardly and outwardly, whereas, the lower section of the door 12 connected at hinge 14 to the upper section of the door 13 will rise upwardly and inwardly, and when raised to a completely upright or open position, section 12 will underlie section 11 in a parallel relationship. Thus the thickness 11 and 12 will be the only space taken up in the closure opening. It is readily seen that the door can be simply opened without resorting to complicated tracks, bars, levers, springs, or other mechanisms which limit the usable space around the opening of a conventional hangar, garage or storage shed type door.

As best illustrated in FIGS. 2, 5 and 5*a*, the door is balanced by means of a counterweight 20 connected by attaching means 21 to a cable 22 through pulley 23 and wraps around winch 17 at position 17*b*. As the door is raised counterweight 20 is lowered and is maintained in place by means of tracks 24.

In theory, the weight of the counterweight 20 is related to the diameters of winch portions 17*a* and 17*b*. If the diameters are the same the counterweight would be the same as the weight of the door. If the diameter of the counterweight portion of winch 17*b* is twice the diameter of the door cable winding portion 17*a* then the counterweight 20 need be only one-half the weight of the bifold door but cable 22 must travel twice as far as cable 15*d*. In actual practice counterweight 20 should be slightly lighter than the weight of the door.

As shown in FIG. 5*a* the counterweight may open at the top and contain removable objects 25 such stones, nuts and bolts, metal balls and the like by which the weight of the counterweight may be adjusted. As illustrated in the drawings, as the door is raised winch 17 rotates such that the cable 15*d* is wound on winch 17*a* and counterweight cable 22 is unwound from winch portion 17*b*. As discussed, counterweight 20 is weighted such that the upward pressure exerted by cable 15*a*, 15*b* and 15*c* in lifting the door will be equal to the downward force exhibited by counterweight 20 so that when upward movement of the door is stopped in any open position, the door will remain balanced and remain in that position.

Thus far the opening and closing of the door has referred to a manual operation, however, there is illustrated in FIGS. 2, 4 and 5 electrical means whereby the door may be electrically opened and closed. As best illustrated in FIG. 5, this consists of a motor mounting framework 26 to which is attached a motor 27 having a pulley 28 attached to the drive shaft thereof. Said pulley is connected by a belt 29, to a larger pulley 30 which serves as a speed reduction means for the rotation of shaft 31 upon which is mounted sprocket wheel 32. Larger sprocket wheel 33 is fixedly mounted at the end of winch 17 and is interconnected with sprocket wheel 32 by means of chain 34.

The diameters of pulleys 28 and 30 and sprocket wheels 32 and 33 are sized such that the proper speed reduction takes place when operating motor 27 to allow cable 15*d* to be wound around drum 17*a* and to allow the counterweight 20 to be lowered and cable 22 to be unwound from drum 17*b*. by adjusting the size of the various pulleys and sprocket wheels the maximum amount of force can be applied with the minimum amount of energy utilization.

It is a particular advantage of the present invention that only minimal energy is required to raise and lower the bifold door. For example, motors in the range of from about one-eighth to one horsepower are sufficient to raise and lower a warehouse or airplane hangar door.

In one embodiment of the invention, shaft 31 contains a threaded extension 31*a* which is connected to levers 35 and 36 which operate limit switches 37 and 38. The hand switch which actuates the limit switches is not shown.

The locking mechanism of the bifold door and the manner in which the door is opened and closed may be interrelated. Sections 11 and 12, when fully closed and locked, are positioned in relation to lifting cables 15*a*, 15*b* and 15*c* such that the weight is off center at hinge 14 as shown in FIG. 11, and will have a natural tendency to pivot at their point of attachment so that the door will spring slightly open as shown by the dashed lines in FIG. 11, when the locking mechanism is released. Such a movement makes it possible for cables 15*a*, 15*b*, and 15*c* which are connected to lower door section 12 by connecting means 59 as shown in FIG. 11, to be raised vertically and sections 11 and 12 to be folded upwardly eliminating the possiblity of sections 11 and 12 being pulled upwardly against each other without pivoting.

To open the door the hand switch is flipped to the up position but limit switch 37 prevents the motor from starting until the locking mechanism has been released and the door has moved slightly open as shown in FIG. 11. With the door slightly ajar the motor will start winding cable 15*d* on winch portion 17*a* and unwinding cable 22 from winch portion 17*b* lowering counterweight 20. As the winch rotates shaft 31*a* will also rotate and levers 35 and 36 will move in the same direction depending on whether the threads on extension 31*a* are right handed or left handed. The rotation of extension 31*a* through levers 35 and 36 move the levers sufficiently that when the door is in a fully upright position limit switch 38 turns the motor off. To close the door the hand switch is turned to the down position reversing the direction in which the motor will turn. As noted in FIG. 5 the limit switches 37 and 38 are connected to the motor by lines 39 and 40. As the door is lowered shafts 31*a* turns in the opposite direction and levers 35 and 36 also move in the opposite direction until the door is in a substantially closed position at which time the limit switch 38 deactivates the motor and the inertia of the moving door causes it to shut and lock. If desired, and to allow sufficient momentum to the door to shut and lock, the bottom of the door may be weighted by a weight 60 as shown in FIG. 11. The total weight of the door and counterweight, however, are substantially the same as previously discussed.

Although the counterweight, motor and winch have been illustrated as being off to the side of the door, such means could be mounted in any other position relative to the door. For example, they could be mounted overhead above the door if there was sufficient room, or outside the building immediately adjacent the door. It is also obvious that by extending the length of the cables the motor and counterweight could be mounted at the back of the room or space wherein the bifold door serves as the front closure.

It is within the skill of the art to locate or relocate the counterweight, winch and motor and specific positioning is not critical to the operation of this invention.

In many instances it is desirable to have lower section 12 of the door fold outwardly and upwardly in order to allow maximum storage space within the building housing the bifold closure. An application already mentioned is an airplane hangar wherein the nose of the airplane nearly touches the door. FIGS. 8, 9 and 10 show an embodiment of the invention wherein section 11 pivots inwardly and section 12 folds outwardly and under section 11 and wherein the winch and counterweight are positioned away from the door. In this instance cable 15*a* would pass over pulleys 16*a* and 16*b* and be joined with cable 15*b* just after cable 15*b* had passed over pulley 16*b*. Cable 15*b* would pass under and around pulley 16*c* and be joined with cable 15*c* just after that cable had passed over pulley 16*c*. The resultant cable designated as cable 15*d* in FIG. 8 would pass around pulley 16*d*, through the structure wall as shown in FIG. 9, and then to winch 17 which is remotely located. Cables 15*a* and 15*b* cables 15*b* and 15*c* are joined by clamps 18 and are separated from each other by cable dividers 19 as previously described. It is noted in this situation that the cables would be mounted on the outside of the door as contrasted to the inside mounting as shown in FIGS. 1–4.

Figure 1:
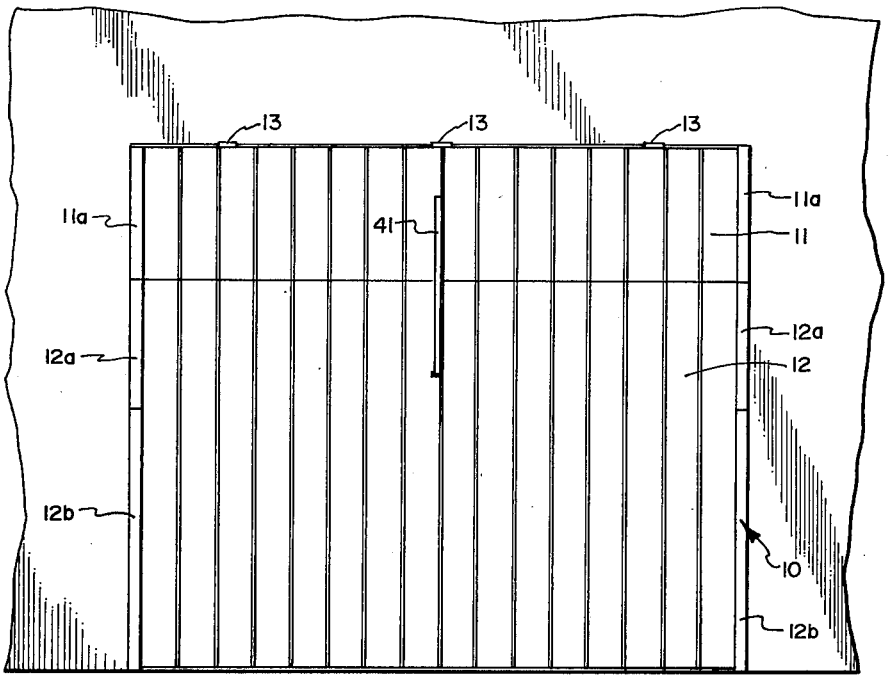
FIG. 1 is a front elevational view of a bifold door in a locked position the upper section of which, when opened, will move in an outward direction and the lower section will fold inwardly thereunder.
Figure 3:
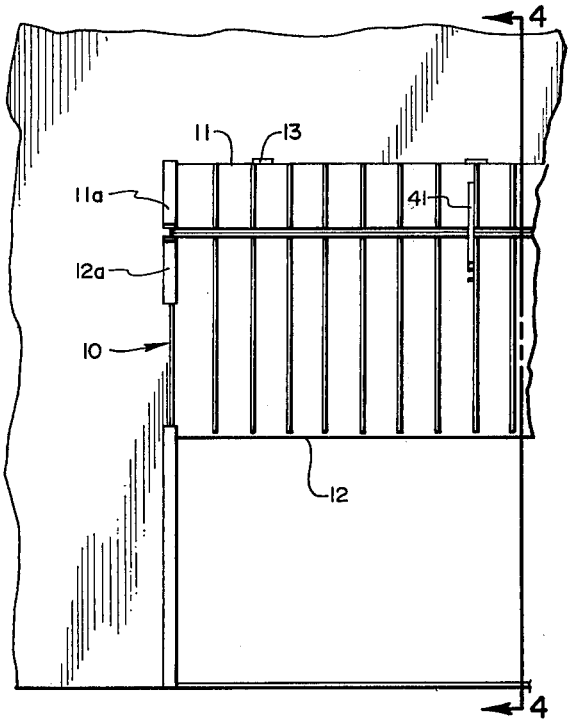
FIG. 3 is a sectional front elevational view of FIG. 1 showing the door in a partially elevated position.

The bifold door 10 may contain a positive locking mechanism as illustrated in FIGS. 1 through 5, 6 and 7 and specifically in FIGS. 6 and 7. As illustrated in FIGS. 1, 3 and 4 the upper section 11 of the bifold door may have permanently attached thereto a restraining bar 41. As illustrated in FIG. 6 which is a section taken along lines 6—6 of FIG. 2 the lower end of restraining bar 41, shown in dotted form, extends down and over the larger section 12 of the bifold door. Restraining bar 41 contains a flat metal extension 47 at the end thereof which is at right angles to bar 47 and which will extend inwardly through section 12 when the door is closed through hole 48. Extension 47 contains a slot 47*a* near the end designed to engage latch bolt 45 as will be discussed. Section 12 contains a latch 42 on the inside thereof designed to fixedly engage the restraining bar 41 in a vertical position by means of extension 47 thereby preventing the door from folding open.

Latch 42 consists of a latch framework 43 fastened against door section 12 immediately below hole 48. The framework 43 has outward extensions at either end and a spring 44 and latch bolt 45 is connected thereto. Spring 44 rests at the bottom of the lower extension of framework 43. Latch 45 as illustrated is cylindrical in shape at the lower portion but flares outwardly at a 90° angle and becomes a rectangular bar having an angled upper surface. The upper portion of spring 44 rests against the outwardly flared shoulders of the latch bolt 45 so that when the bolt is pushed downwardly the spring is compressed, and when no pressure is placed upon bolt 45 the spring will resume its extended position. There is an aperture in the lower portion of framework 43 to allow the cylindrical end of the latch bolt to pass therethrough. Likewise the top extension of framework 43 contains a rectangular aperture through which the upper end of latch bolt 45 will pass. The upper end of latch 45 is angular in shape so that when the extension 47 comes into contact with latch bolt 45, the latch bolt will move downwardly compressing spring 44 until the extension has passed into a horizontal position, at which time the spring will push the latch bolt upwardly through slot 47*a* thereby holding restraining bar 41 firmly in place. Attached to the lower portion of latch bolt 45 is a cable 46 or other appropriate means, which is shown in FIG. 6. If this is the only locking mechanism used the door may be opened readily by pulling downward on the cable 46 thereby pulling latch bolt 45 downward below extension slot 47*a* and pushing inward and upward on the lower section 12 in order to open the door. However, FIGS. 2, 7 and 8 illustrate further locking mechanisms which are preferably used. These locking mechanisms may consist of one or more interconnected triangular shaped latch releases 49, as illustrated in FIG. 2 and more specifically illustrated in FIG. 7 which shows a section taken along lines 7—7 of FIG. 2. The latch releases 49 are connected to the lower section of door section 12 by means of a pivot bolt 51, and are interconnected with each other by means of latch release connectors 50. A foot pedal 52 is connected to one end of latch release 49. The remaining latch releases 49 contain holes in the upper triangular corners thereof, which when foot pedal 52 is depressed downwardly as illustrated in FIG. 8, the hole 49*a* opposite the foot pedal will move upwardly and since latch release connector 50 will be connected to holes in similar positions in each of the other latch releases, each subsequent latch release 49 will also be caused to rotate in the same direction. However, as illustrated in FIG. 2, cable 46 which is connected into hole 49*b* will be caused to rotate downwardly when pedal 52 is depressed thereby causing latch bolt 45 to be depressed releasing the restraining bar as already described.

With the depression of foot pedal 52 as shown in the drawings, the latch releases 49 will rotate in a direction to release floor latch 53. Floor latch 53 is similar in construction to latch 52 and consists of a latch framework 54 having upward extensions at the top and bottom thereof. A latch spring 55 and a latch bolt 56 are provided which are similarly shaped to latch spring 44 and latch bolt 45. The latch bolt is connected to the latch release mechanism by means of a connecting rod 57 and the latch bolt when the bifold door is in a completely closed position locks into floor notch or indentation 58. The floor latches are released by depressing pedal 52 which causes latch release mechanism to rotate in a direction which causes the portion of the release containing hold 49*a* to rotate upwardly, thereby exerting enough pressure on connecting rod 49 which pulls latch bolt 56 free from locking mechanism or floor notch 58 and the door thus can be opened either manually or electrically as described. Obviously, other locking mechanisms may also be utilized without departing from the scope of the present invention. It is also obvious that the locking mechanism may be adapted to a door opening outwardly as well as inwardly.

An advantageous feature of door 10 as also illustrated in FIGS. 1, 3 and 4 is that it is self-sealing against the intrusion of outside elements, such as wind, rain, heat, cold and the like. As illustrated in FIG. 3 and 4, when the bifold door is opened vertically the upper bifold section 11 swings upwardly and outwardly whereas the lower section 12 swings upwardly and inwardly. Attached to upper section 11 is a strip of sealing material or weather stripping 11*a*, which rises with the door. Likewise, attached to the upper portion of lower section 12 is a weather strip 12*a*, which is of sufficient length that it rises upwardly with the bifold door but does not extend into the closure opening; in other words, it is approximately the same length as strip 11 a. The remaining section of the weather stripping device section 12*b* is attached to the framework surrounding the opening to be closed so that when the door is in a closed position the top portion of strip 12*b* just meets strip 12*a* thereby providing for a complete seal of the sides of the doors 10 against intrusion of outside elements. On an outwardly opening door the positioning of the weather strip would be on the inside of the door and framework.

Although the invention as has been described is deemed to be that which would form the preferred embodiment of the invention, it is recognized that departures may be made therefrom without departing from the scope of the invention which is not to be limited to the details disclosed, but to be accorded the full scope of the claims so as to include any and all equivalent closures.

What is claimed is:

1. A counterbalanced vertically moveable bifold closure comprising two unequal rectangular sections, the first and smaller of said sections forming the upper portion of said closure said upper portion having at least one restraining bar attached thereto adapted to extend past the bottom of the upper section and overlap the lower section when the door is in a completely closed position thereby holding the door in a restrained vertical position said restraining bar having latching means at the lower end thereof, the second and larger section being pivotally attached to the opposite side of said first section in such a manner that the pivotal movement of said second section will be in a direction opposite the pivotal movement of said first section said larger section containing means to interengage the latching means of the restraining bar of the smaller section, cable means attached to one facing of said second section and connected by pulley means to a counterweight such that when the counterweight is lowered the cable connected to the facing of the lower section will move substantially vertically causing the lower and upper section to pivot upwardly and rotate from a vertical to a horizontal position in opposite directions, said first and second sections being positioned in relation to the cable means such that the weight of the closure is off center in a closed position and will spring slightly open when the latching means of the restraining bars and the interengaging means of the second section are disengaged, the cable means attached to one facing of the second section being connected by pulley means to one section of a winch having different diameters and the counterweight being connected to an adjacent section of the winch such that when the winch is rotated in one direction the counterweight cable is unwound and the counterweight is lowered and the cable means connected to the facing of the lower closure section is wound up on said winch and the bifold closure is raised, the diameter of the various portions of said winch and the weight of said counterweight means being such that the downward force exerted by the counterweight means is substantially equal to the downward force exerted by the weight of the upper and lower closure sections thereby balancing the bifold closure in any open position.

2. A bifold closure according to claim 1 wherein the downward force exerted by the counterweight is slightly less than the weight exerted by the weights of the bifold closure sections to allow the door to spring slightly open when the latching means of the restraining bar and interengaging means of the lower closure are disengaged, but which is sufficiently equal to allow the bifold closure to be maintained in any desired opened position.

3. A bifold closure according to claim 2 wherein the bottom portion of the lower section contains means interengaged with the restraining bar and latching sections thereof adapted to further lock the bifold closure in a vertical position when fully closed.

4. A bifold closure according to claim 3 wherein the bottom portion of the second section is weighted to provide momentum to the bifold closure when closing which momentum is sufficient to overcome the off center tendency of the door to partially open thereby allowing the bifold closure to shut and lock in a vertical position.

5. A bifold closure as claimed in claim 4 wherein when fully opened the upper and lower sections are in a horizontal position with each section lying flat against the other in a parallel relationship.

6. A bifold closure as claimed in claim 5 wherein in the closed position the vertical width of the upper section is less than the vertical width of the lower section.

7. A bifold closure as claimed in claim 6 wherein the vertical width of the upper section is about one-fourth the vertical width of the bifold closure.

8. A bifold closure according to claim 7 wherein the cables are attached to the lower section about one-third of the vertical distance from the top of said section.

9. A bifold closure as claimed in claim 8 wherein the weight of the counterweight is adjustable.

10. A bifold closure as claimed in claim 6 wherein, the closure is opened and closed by means of an electric motor attached to the winch by means of appropriate speed reductions, said motor being activated by means of two limit switches, the first being the limit switch which activates the motor for opening the bifold closure and deactivates the motor to allow the bifold closure to close, said switch being so interconnected with the bifold closure that said limit switch will not be activated until all locking means have been disengaged including the latching means at the end of the restraining bar attached to the first section which overlaps and is interengaged with the second section and the bifold closure has moved partly open, provided further that said first limit switch will also deactivate the motor before the bifold closure is completely closed during the closing cycle, the second limit switch operating to deactivate the motor when the bifold closure is fully opened and which is activated causing the motor to operate in reverse direction to reverse operation of the winch in lowering said closure.

11. A bifold closure as claimed in claim 10 wherein the upper and lower sections are joined so as to touch against each other and be in the same vertical plane only when in a locked position.

12. A bifold closure according to claim 11 wherein the bifold closure is manually closed and locked after deactivation of the motor upon lowering of the bifold closure.

13. A bifold closure according to claim 11 wherein the bifold closure closes and locks in a vertical position by means of the inertia of the closing bifold closure after the motor has been deactivated.

14. A bifold closure according to claim 13 wherein the bottom portion of the second section is weighted to provide momentum to the bifold closure when closing which momentum is sufficient to overcome the off center tendency of the door to partially open thereby allowing the bifold closure to shut and lock in a vertical position after the motor has been deactivated by the first limit switch.

* * * * *